US009152119B2

(12) United States Patent
Takai et al.

(10) Patent No.: US 9,152,119 B2
(45) Date of Patent: Oct. 6, 2015

(54) COOLING DEVICE AND IMAGE FORMING APPARATUS

(75) Inventors: Shingo Takai, Ibaraki (JP); Yutaka Shoji, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 13/200,822

(22) Filed: Oct. 3, 2011

(65) Prior Publication Data

US 2012/0087703 A1 Apr. 12, 2012

(30) Foreign Application Priority Data

Oct. 8, 2010 (JP) ..... 2010-228131

(51) Int. Cl.
*G03G 15/20* (2006.01)
*G03G 15/00* (2006.01)

(52) U.S. Cl.
CPC ..... *G03G 15/6573* (2013.01)

(58) Field of Classification Search
None
See application file for complete search history.

(56) References Cited

U.S. PATENT DOCUMENTS

| | | | | | |
|---|---|---|---|---|---|
| 3,987,757 | A | * | 10/1976 | Leising | 118/641 |
| 4,370,048 | A | * | 1/1983 | Shibuya et al. | 399/398 |
| 5,778,294 | A | * | 7/1998 | Hiraoka et al. | 399/329 |
| 6,619,657 | B2 | * | 9/2003 | Horikoshi et al. | 271/188 |
| 7,136,611 | B1 | * | 11/2006 | Murase | 399/165 |
| 2003/0228180 | A1 | * | 12/2003 | Mitsuya et al. | 399/341 |

FOREIGN PATENT DOCUMENTS

| | | | | | |
|---|---|---|---|---|---|
| JP | 4-260065 | A | | 9/1992 | |
| JP | 04-340561 | A | | 11/1992 | |
| JP | 04-4340561 | A | | 11/1992 | |
| JP | 11-015308 | | * | 1/1999 | G03G 15/20 |
| JP | 11015308 | A | * | 1/1999 | |
| JP | 2000-038207 | A | | 2/2000 | |
| JP | 2000038207 | A | * | 2/2000 | B65G 15/64 |
| JP | 2001-002271 | A | | 1/2001 | |
| JP | 3509212 | B2 | | 1/2004 | |
| JP | 3547031 | B2 | | 4/2004 | |
| JP | 2005-134805 | A | | 5/2005 | |
| JP | 2006-003819 | A | | 1/2006 | |
| JP | 2006-208678 | A | | 8/2006 | |
| JP | 2007-008677 | A | | 1/2007 | |
| JP | 4026125 | B2 | | 10/2007 | |

(Continued)

OTHER PUBLICATIONS

JP_2010026379_A_H.pdf (Machine Translation).*

(Continued)

*Primary Examiner* — Clayton E LaBalle
*Assistant Examiner* — Victor Verbitsky
(74) *Attorney, Agent, or Firm* — Harness, Dickey & Pierce

(57) ABSTRACT

A cooling device includes: a cooling roller that cools down a sheet-like member by coming into contact with the sheet-like member; a belt member that is rotatably extended by a plurality of extending members, presses the sheet-like member against the cooling roller, and holds and carries the sheet-like member; and a driving roller that serves as one of the plurality of extending members and drives to rotate the belt member, wherein the driving roller is axially divided into a plurality of rollers and each of the plurality of rollers has a crown-like shape whose outer diameter continuously becomes larger from both end parts to a center part in an axial direction.

8 Claims, 5 Drawing Sheets

(56) References Cited

FOREIGN PATENT DOCUMENTS

| | | | |
|---|---|---|---|
| JP | 2008033068 | A | 2/2008 |
| JP | 4114864 | B2 | 4/2008 |
| JP | 2009-265421 | A | 11/2009 |
| JP | 2010-026379 | A | 2/2010 |

OTHER PUBLICATIONS

JP 2010026379__A__H.pdf (Machine Translation).*

English language abstract for patent publication No. JP-2004-279542 which corresponds to JP-4114864-B2.
English language abstract for patent publication No. JP-2004-010243 which corresponds to JP-4026125-B2.
English language abstract for patent publication No. JP-11-015308 which corresponds to JP-3547031-B2.
English language abstract for patent publication No. JP-08-054790 which corresponds to JP-3509212-B2.
Japanese Office Action dated Aug. 1, 2014 for corresponding Japanese Application No. 2010-228131.

* cited by examiner

Δh1> Δh2

COOLING DEVICE AND IMAGE FORMING APPARATUS

CROSS-REFERENCE TO RELATED APPLICATIONS

The present application claims priority to and incorporates by reference the entire contents of Japanese Patent Application No. 2010-228131 filed in Japan on Oct. 8, 2010.

BACKGROUND OF THE INVENTION

1. Field of the Invention

The present invention relates to a cooling device used for an image forming apparatus such as a printer, a facsimile, and a copying machine and to an image forming apparatus including the cooling device.

2. Description of the Related Art

As an image forming apparatus, well known is the one in which an electrophotography technology is used to form a toner image on a sheet of paper serving as a sheet-like member; and the toner is melted and fused by passing through a fixing device. As a printing speed becomes faster, has known is an image forming apparatus including a cooling device for quickly cooling down a sheet of paper heated by a fixing device.

Japanese Patent Application Laid-open No. 2006-003819 discloses an image forming apparatus in which a cooling device is provided at a downstream side of a fixing device in a sheet carrying direction. The cooling device includes a cooling roller for coming into contact with a sheet of paper, carrying and cooling down the sheet of paper. In the cooling device, two rollers are provided at an interval in the sheet carrying direction and extend thereon a carriage belt made of an elastic member for carrying the sheet of paper. One roller extending the carriage belt thereon rotates the carriage belt as a driving roller. Moreover, a cooling roller is provided between the two rollers extending the carriage belt thereon so as to come into contact with a top surface of the carriage belt. The cooling roller is turned around to rotate by power that conveys the carriage belt. The sheet of paper, heated to a high temperature while passing through the fixing device, is held and carried on the carriage belt to a nip region formed by the cooling roller and the carriage belt coming into contact with each other, where the sheet of paper is brought into contact with the cooling roller, so that heat of the sheet of paper is absorbed by the cooling roller and the sheet of paper is cooled down.

In order to suppress meandering of the carriage belt, there is a driving roller for rotating the carriage belt that has a so-called crown-like shape. That is a drum-like shape in which a diameter at an axial center part of the driving roller is larger than that at both ends thereof. With the driving roller having a crown-like shape, it becomes difficult for the carriage belt to move beyond the axial center part of the driving roller in an axial direction of the driving roller, so that meandering of the carriage belt can be suppressed.

However, since the crown-like shape driving roller has different diameters at the center part and at the end parts of the driving roller, tension of the carriage belt at the axial center part of the driving roller becomes larger than tension of the carriage belt at the axial end parts of the driving roller, which causes a difference in tension of the carriage belt in the axial direction of the driving roller. The difference in tension of the carriage belt causes a difference in pressure against the sheet of paper from the carriage belt in the axial direction of the driving roller when the sheet of paper is held by the cooling roller and the belt. The difference in pressure causes a problem of unevenness in gloss of an image on the sheet of paper.

SUMMARY OF THE INVENTION

It is an object of the present invention to at least partially solve the problems in the conventional technology.

In an aspect of the present invention, there is provided a cooling device including: a cooling roller that cools down a sheet-like member by coming into contact with the sheet-like member; a belt member that is rotatably extended by a plurality of extending members, presses the sheet-like member against the cooling roller, and holds and carries the sheet-like member; and a driving roller that serves as one of the plurality of extending members and drives to rotate the belt member. The driving roller is axially divided into a plurality of rollers and each of the plurality of rollers has a crown-like shape whose outer diameter continuously becomes larger from both end parts to a center part in an axial direction.

In another aspect of the present invention, there is provided an image forming apparatus including: a toner image forming unit that forms a toner image on a sheet-like member; a fixing unit that fixes the toner image formed on the sheet-like member onto the sheet-like member at least by heat; and a cooling unit that cools down the sheet-like member. The cooling device mentioned above is used as the cooling unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Description will be given below on one embodiment applied to an electrophotography copying machine (hereinafter, simply referred to a "copying machine") serving as an image forming apparatus.

Figure 2:
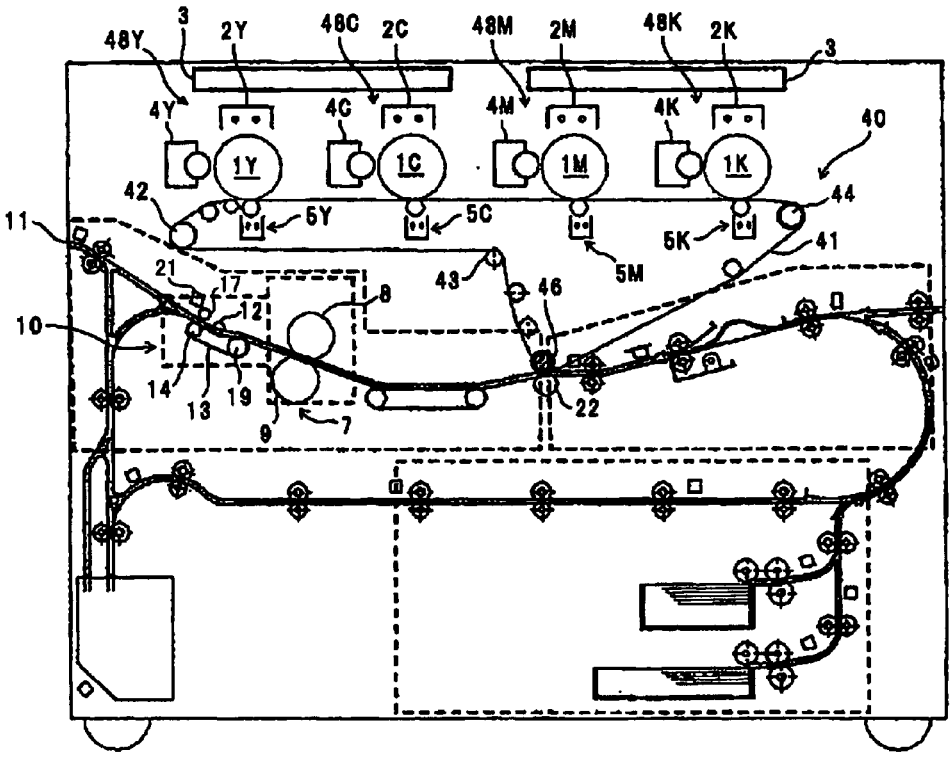
FIG. 2 is a schematic diagram of a copying machine according to the present embodiment.

FIG. 2 is a schematic view of a copying machine according to the present embodiment.

In the copying machine, a transfer apparatus 40 is provided for extending and endlessly moving an intermediate transfer belt 41 serving as an endless moving body counterclockwise in the drawing. The transfer apparatus 40 includes, in addition to the intermediate transfer belt 41, four primary transfer units 5Y, 5C, 5M, 5K and the like.

The intermediate transfer belt 41 is, while being extended on extending rollers such as a driving roller 44, a tension roller 43, a secondary transfer opposite roller 46, and a driven roller 42, driven to rotate in a clockwise direction in FIG. 2. The driving roller 44 is driven to rotate by a driving source such as a motor (not illustrated). Driving force of the driving source is transmitted from the driving roller 44 to the intermediate transfer belt 41 and the intermediate transfer belt 41 rotates at a given speed.

In a belt-extended part between the driving roller 44 and the driven roller 42, four image forming units 48Y, 48C, 48M, and 48K for yellow (Y), cyan (C), magenta (M), and black (B), respectively, are parallel arranged. In an image forming unit 48, a corona charging unit 2, a developing unit 4 and the like are provided around a photosensitive element 1 as a latent image carrier. Moreover, a primary transfer unit 5 is arranged in a position facing the photosensitive element 1 through the intermediate transfer belt 41.

Above the image forming units 48Y, 48C, 48M, and 48K, two image writing devices 3 are provided. The image writing devices 3 are devices that form an electrostatic latent image based on image information transmitted from a personal computer and the like on photosensitive elements 1Y, 1C, 1M, and 1K provided in the respective image forming units 48.

Moreover, a secondary transfer roller 22 is provided in a position facing the secondary transfer opposite roller 46 through the intermediate transfer belt 41. The secondary transfer roller 22 is pressed by biasing means such as a spring (not illustrated) in the direction toward the intermediate transfer belt. The secondary transfer opposite roller 46 and the secondary transfer roller 22 hold the intermediate transfer belt 41 therebetween to form a secondary transfer nip. When a secondary transfer bias having an opposite polarity of toner is applied by a power source (not illustrated) to the secondary transfer roller 22, a secondary transfer electric field is formed in the secondary transfer nip. When a toner image on the intermediate transfer belt 41 is secondarily transferred to a sheet of paper S serving as a sheet member, the secondary transfer bias is applied to the secondary transfer roller 22 to form the secondary transfer electric field in the secondary transfer nip. Using the secondary transfer electric field and nip pressure, a four-color toner image on the intermediate transfer belt 41 is collectively transferred to the sheet of paper S. Along with a white color of the sheet of paper S, a full-color image is formed on a printing surface of the sheet of paper S.

After finishing the secondary transfer in the secondary transfer nip, the sheet of paper S is carried to a fixing unit 7 arranged at a downstream of the secondary transfer nip in the sheet carrying direction. The fixing unit 7 is structured to bring a heating roller 8 incorporating a heater lamp and a pressing roller 9 having a surface covered with an elastic body into contact with each other. At a downstream of the fixing unit 7 in the sheet carrying direction, a cooling device 10 is provided for cooling the sheet of paper S.

Next, operation of the copying machine in the present embodiment will be described.

The corona charging unit 2 charges a surface of the photosensitive element 1 and with writing light from the image writing device 3, an electrostatic latent image is generated on the surface of the photosensitive element 1. The developing unit 4 causes powder toner to electrically adhere to the electrostatic latent image formed on the photosensitive element 1 and visualize the image. The toner image visualized on the photosensitive element 1 is transferred by the primary transfer unit 5 from the photosensitive element 1 onto the intermediate transfer belt 41. The toner image transferred on the intermediate transfer belt 41 is transferred from the intermediate transfer belt 41 to a top surface of the sheet of paper S at the secondary transfer nip. Subsequently, the sheet of paper S having the toner transferred thereon is carried inside the fixing unit 7 and heat and pressure are applied thereto by passing through between the heating roller 8 and the pressing roller 9, whereby the tonner image is fixed on the sheet of paper S. The sheet of paper S having the toner image thus fixed thereon is carried to the cooling device 10 provided at a downstream side of the fixing unit 7 in the sheet carrying direction and is cooled down, and then is discharged from a discharging port 11 outside the apparatus.

Figure 3:
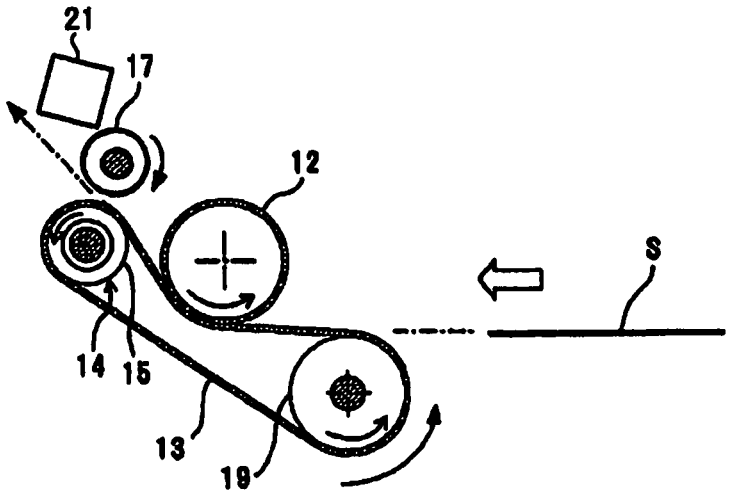
FIG. 3 is a schematic diagram of a cooling device according to the present embodiment.

FIG. 3 is a schematic diagram of the cooling device 10 according to the present embodiment. The cooling device 10 is provided with a driving roller 14 and a driven roller 19 that are arranged at an interval in the paper P carrying direction (left to right direction) and stretch a flat belt 13 of an elastic member for holding and carrying the sheet of paper S. The driving roller 14 is connected to a driving source (not illustrated). When the driving roller 14 rotates counterclockwise in the drawing, the flat belt 13 rotates counterclockwise in the drawing and carries the sheet of paper S held on a top surface of the flat belt 13 from the right side to the left side in the drawing. It should be noted that the driven roller 19 is turned around by rotation of the flat belt 13 and rotates counterclockwise in the drawing. Moreover, the driven roller 19 may be formed by a single roller member (single roller) or may be formed by a plurality of rollers obtained by axially dividing a roller member.

In an intermediate position between the driving roller 14 and the driven roller 19, a cooling pipe 12 that is a tube-like roller is pressed against the flat belt 13 from above and the cooling pipe 12 is turned around to rotate by power to go forward of the flat belt 13. For the cooling pipe 12, the one including a fin 12*a* (see FIG. 1, for example) for air cooling, a circulation mechanism of a coolant and the like may be used. Moreover, above the driven roller 19, a paper receiving guide 21 (as shown in FIG. 2) is provided for guiding the sheet of paper S carried from the fixing unit 7. Above the driving roller 14, a paper discharging guide is provided for guiding the sheet of paper S from the cooling device 10 to the discharging port 11.

The sheet of paper S heated while passing through the fixing unit 7 passes through a nip region formed by the cooling pipe 12; and the flat belt 13 in the cooling device 10 and is discharged from the discharging port 11 outside the apparatus. At this time, in the nip region formed by the cooling pipe 12 and the flat belt 13 coming into contact with each other, the sheet of paper S is pressed against the cooling pipe 12 by tension of the flat belt 13 and carried. Therefore, since the sheet of paper S passes the nip region while being in close contact with the cooling pipe 12, heat of the sheet of paper S is absorbed by the cooling pipe 12 and the sheet of paper S is sufficiently cooled down. Moreover, by bringing the sheet of paper S into contact with the cooling pipe 12 in a wide area, it is possible to more efficiently cool down the sheet of paper S.

Furthermore, in the present embodiment, as illustrated in FIG. 3, a driven roller 17 is provided at an exit of the cooling device 10 in a position facing the driving roller 14 with the flat belt 13 interposed therebetween without coming into contact with the flat belt 13. Therefore, a curved roller surface of the driven roller 17 suppresses contact of the sheet of paper S having insufficiently solidified toner on a surface thereof due to residual heat right after ejection from the cooling device 10 with a sharp part, such as an end part of a paper discharging guide 21 (as shown in FIG. 2). It can also suppress occurrence of linier damage on an image on the sheet of paper S.

Figure 4:
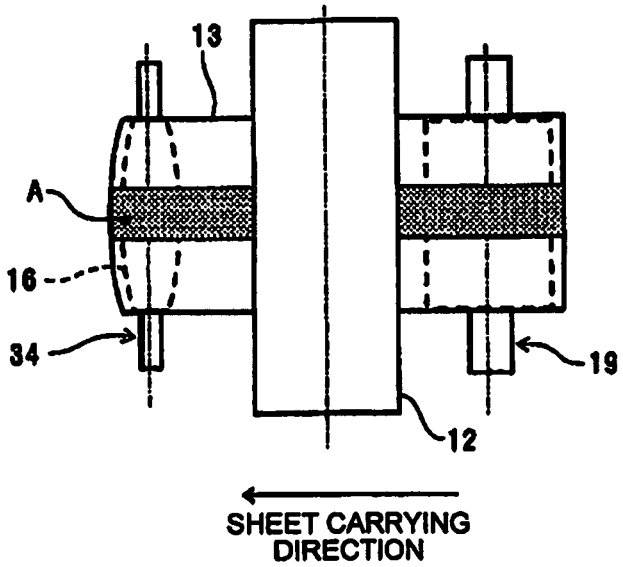
FIG. 4 is a view of an example of a conventional cooling device.

Here, in most conventional cooling devices, as illustrated in FIG. 4, in order to prevent meandering of the flat belt 13, a roller 16 of a driving roller 34 that rotates the flat belt 13 has a so-called crown-like shape which is a drum-like shape having a larger diameter of a center part A in the axial direction of the driving roller 34 than that of end parts. However, tension of the flat belt 13 at the center part A in the axial direction of the driving roller 34 is larger than that of other parts. Accordingly, when the sheet of paper S is held between the cooling pipe 12 and the flat belt 13, pressure from the flat belt 13 against the sheet of paper S also becomes larger at an area corresponding to the center part A of the roller 16 of the driving roller 34 (hatching part of the flat belt 13) than other areas, and a difference in pressure causes gloss unevenness in some cases. That is, a partial difference in tension of the belt at a toner solidifying step causes occurrence of gloss unevenness of an image on the sheet of paper S.

It should be noted that occurrence of a difference in pressure, which causes gloss unevenness, is not limited to a case when the driving roller having a crown-like shape is formed by a single roller member as illustrated in FIG. 4. The gloss unevenness caused by the difference also occurs for the same reasons as described above when it is formed by a plurality of rollers formed by axially dividing a roller member and the plurality of rollers form a single crown-like shape as a whole.

Furthermore, even when the driving roller having a so-called reverse crown-like shape in which the outer diameter of the driving roller becomes continuously smaller from both end parts to the center part is used, there occurs a difference in tension of the flat belt 13 in the axial direction of the driving roller. Accordingly, there occurs in turn a difference in pressure from the flat belt 13 against the sheet of paper S in the axial direction of the driving roller and the difference in pressure causes gloss unevenness.

Particularly in an electrophotography color image forming apparatus, color image formation has been widely employed in recent years and in order to obtain high-level image quality, an oil-less fixing device has become widely used. The phenomenon of gloss unevenness, which occurs in an image on the sheet of paper S as described above, is a particularly prominent phenomenon of the electrophotography color image forming apparatus employing oil-less fixing.

In other words, when the sheet of paper S is cooled down by the cooling device, an image made of toner on the sheet of paper is easily affected by pressure and a cooling time and as a result, changes in a surface state lead to a state where the gloss unevenness of the image on the sheet of paper readily occurs.

Figure 1:
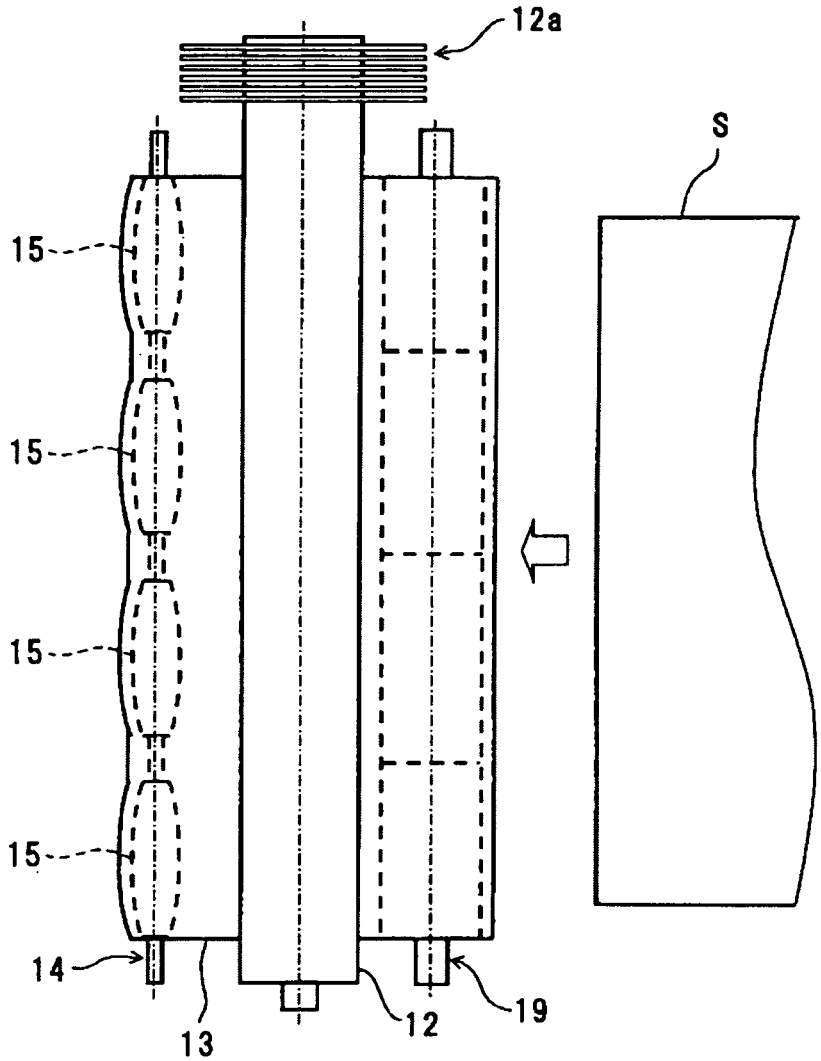
FIG. 1 is a schematic view of a cooling device according to an embodiment when viewed from above.

On the other hand, in the cooling device 10 of the present embodiment, as illustrated in FIG. 1, the driving roller 14 for extending and driving the flat belt 13 to rotate is axially divided into a plurality of rollers 15 and each of the plurality of rollers 15 has a crown-like shape whose outer diameter continuously becomes larger from both end parts to a center part in the axial direction.

Figure 5:
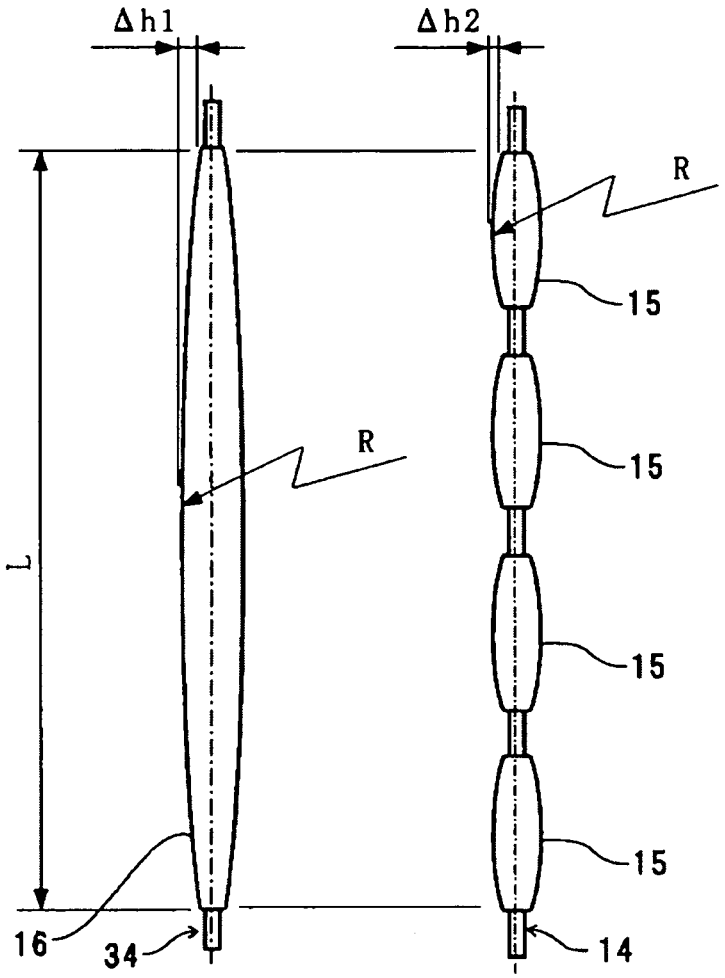
FIG. 5 presents schematic views of a driving roller configured by a single roller and a plurality of rollers, each of the rollers having an equal curvature radius.

In the case where the driving roller 14 is structured by the plurality of rollers 15 having a crown-like shape, there is a smaller difference ($\Delta h1>\Delta h2$) between the center part and the end parts in the axial direction of the roller 15 having a crown-like shape, than in the case where the driving roller 34 is structured by the single roller 16 having a curvature radius R equal to that of the rollers 15 as illustrated in FIG. 5. Accordingly, than in the case where the flat belt 13 is extended by the driving roller 34 formed by the single roller 16 having a curvature radius R equal to that of the rollers 15, there is a smaller difference in partial tension of the flat belt 13 in the axial direction of the driving roller in the case where the flat belt 13 is extended by the driving roller 14 formed by the plurality of rollers 15 having a crown-like shape with the curvature radius R. Therefore, while the plurality of rollers 15 having a crown-like shape in the driving roller 14 maintain a function to suppress meandering of the flat belt 13, it is possible to make variability in tension of the flat belt 13 smaller in the axial direction of the driving roller. Therefore, compared with the case where there is large variability in tension of the flat belt 13 in the axial direction of the driving roller by using the driving roller 34 formed by the single roller 16, it is possible to reduce gloss unevenness caused by a difference in pressure against the flat belt 13 in the axial direction of the driving roller.

Figure 6:
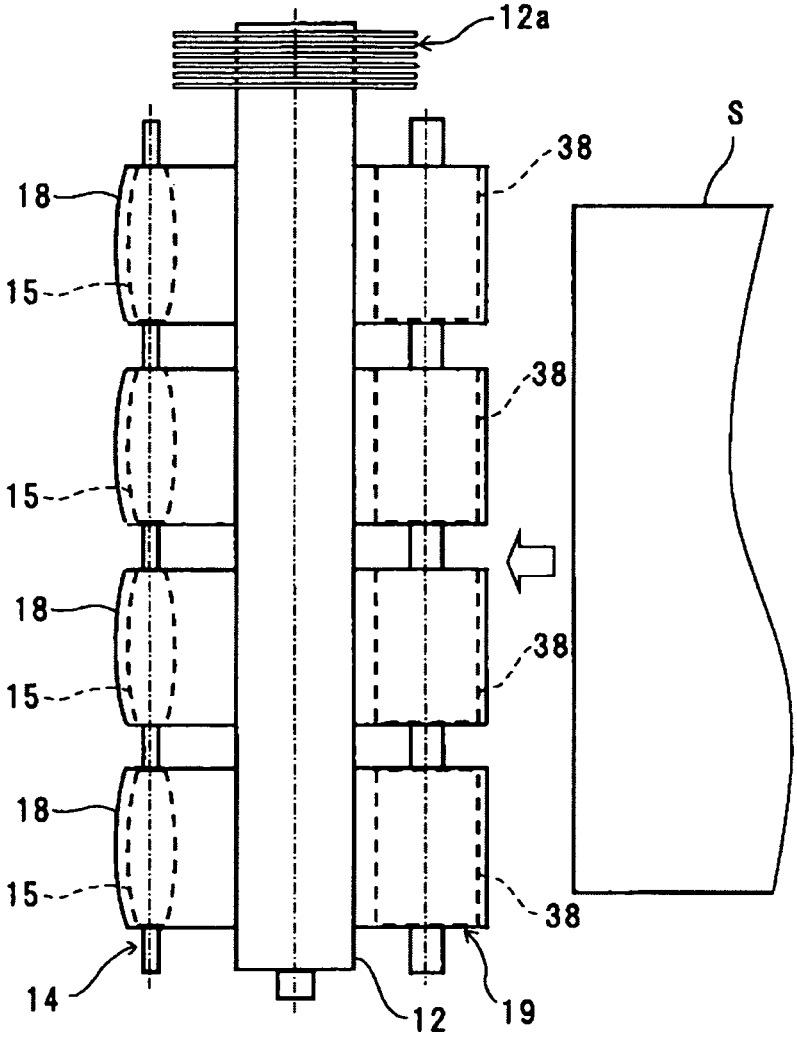
FIG. 6 is a schematic view of a cooling device viewed from above, in which a driving roller is divided into a plurality of rollers in the axial direction and a plurality of flat belts each having a nearly equal width to the width of the divided roller in the axial direction are extended on the plurality of rollers.

Here, since the driving roller 14 is formed by the plurality of rollers 15 having a crown-like shape, as illustrated in FIG. 6, it is considered to employ such a structure that a flat belt 18 having a width nearly equal to the width of the rollers 15 in the axial direction is extended around each of the rollers 15 and the plurality of flat belts 18 hold and carry the sheet of paper S. It should be noted that in FIG. 6, the driven roller 19 is also axially divided into a plurality of rollers 38 and the plurality of rollers 38 extend the respective flat belts 18, along with the plurality of rollers 15. However, since a niche is inevitably formed between the neighboring flat belts in the axial direction of the driving roller in this structure, when the sheet of paper S is pressed against the cooling pipe 12 by tension of the flat belts 18, there occurs a difference in pressure in an axial direction or a difference in heat amount that the cooling pipe 12 and the flat belt 18 absorb from the sheet of paper S. As a result, there are some cases where gloss unevenness occurs in an image on the sheet of paper S.

On the other hand, the cooling device 10 of the present embodiment, in which the driving roller 14 formed by the plurality of rollers 15 having a crown-like shape and the single flat belt 13 having a nearly equal width to that of the driving roller 14 in the axial direction is extended thereon, can suppress occurrence of gloss unevenness potentially caused by the niche between the neighboring flat belts for the reasons described above with reference to FIG. 6.

Furthermore, in order only to reduce variability in tension of the flat belt 13 in the axial direction of the driving roller, it is necessary that the plurality of rollers 15 of the driving roller 14 have no crown-like shape and the diameter in the axial direction of the rollers 15 is made equal from one end side to the other end side. However, in this case, the flat belt 13 is more easily to meander. Accordingly, it is considered to employ such a structure that the plurality of rollers 15 each having a flat shape rather than a crown-like shape are made to be individually driven and when the flat belt 13 meanders, the rollers 15 individually change a rotation speed to correct meandering of the flat belt 13. However, since detection means that detects meandering of the flat belt 13 and individual driving sources for each of the plurality of rollers 15 are necessary to be provided, an apparatus becomes enlarged and a cost becomes higher.

Accordingly, like the driving roller 14 provided in the cooling device 10 of the present embodiment, the plurality of rollers 15 each having a crown-like shape can rotate the flat belt 13 having a width nearly equal to that of the driving roller 14 in the axial direction without causing meandering, resulting a small difference in tension that does not cause gloss unevenness of an image on the sheet of paper S, while suppressing an increase in the size of the apparatus and a cost increase.

It should be noted that the inventors of the present embodiment conducted experiments by setting the thickness of the flat belt 13 of an elastic body to about 1 [mm]; the rubber hardness to about 55 [hs] (JIS K6253 type A); the belt extension rate as tension of the flat belt 13 to about 4 [%]; the diameter at a center part of the driving roller 14 to Ø19 [mm]; the curvature radius of a crown-like shape to about 1400 [mm]; and the width of four pieces of the rollers 15 to 330 [mm]. The obtained results showed an excellent effect to prevent gloss unevenness while maintaining a function to prevent the flat belt 13 from meandering.

Moreover, the structure employed in the cooling device 10 according to the present embodiment also enables an electrophotography color image forming apparatus that employs oil-less fixing to reduce gloss unevenness of an image on the sheet of paper S and to suppress occurrence of linear damage.

According to the present embodiment, in the cooling device 10 that includes the cooling pipe 12 that is a cooling roller for cooling the sheet of paper S serving as a sheet-like member; the flat belt 13 that is a belt member rotatably extended by an extending roller that is a plurality of extending members for pressing the sheet of paper S against the cooling pipe 12, and holding and carrying the sheet of paper S; and the driving roller 14 that is one of the plurality of extending rollers for driving to rotate the flat belt 13, the driving roller 14 is divided into the plurality of rollers 15 in the axial direction and each of the plurality of rollers 15 has a crown-like shape. Since the driving roller 14 is formed by the plurality of rollers 15 each having a crown-like shape, it is possible to make a difference in diameter between at a center part and an end part in the axial direction of the rollers 15 smaller than that of an axially undivided single driving roller having a crown-like shape with a curvature equal to that of the rollers 15. Therefore, the difference in diameter in the axial direction of the driving roller 14 formed by the plurality of rollers 15 is made smaller than that of the single driving roller described above, so that a difference in tension of the flat belt 13 in the axial direction of the driving roller can be made smaller accordingly that of the single driving roller described above. Therefore, when the sheet of paper S is held and carried by the cooling pipe 12 and the flat belt 13, a difference in pressure applied against the sheet of paper S from the flat belt 13 in the axial direction of the driving roller can be made smaller and it is thereby possible to reduce gloss unevenness of an image on the sheet of paper S caused by the difference in pressure.

Furthermore, according to the present embodiment, the cooling pipe 12 may have a heat radiator, such as the fin 12*a* for air cooling and a circulation mechanism of a coolant.

Furthermore, according to the present embodiment, the driven roller 17 serving as a roller member is provided facing the driving roller 14 without coming into contact with a top surface of the flat belt 13. The driven roller 17 is thereby capable of suppressing contact of the sheet of paper S having insufficiently solidified toner on a surface thereof due to residual heat right after ejection from the cooling device 10 with a sharp part, such as an end part of a paper guide. It can also suppress occurrence of linier damage on an image on the sheet of paper S.

Furthermore, according to the present embodiment, in an image forming apparatus that includes the image forming units 48 serving as toner image forming units that form a toner image on the sheet of paper S serving as a sheet-like member; the fixing unit 7 serving as a heat fixing unit that fixes the toner image formed on the sheet of paper S at least by heat; and a cooling unit that cools down the sheet of paper S, the cooling device 10 of the present embodiment is used as the cooling unit and the cooling device 10 is provided at a downstream side of the fixing unit 7 in the sheet carrying direction to cool down the sheet of paper S on which the toner image is fixed by the fixing unit 7. It is thereby possible to reduce gloss unevenness of an image on the sheet of paper S and to suppress occurrence of linear damage.

In the present embodiment, since the driving roller is formed by a plurality of rollers each having a crown-like shape, it is possible to make a difference in diameter between an axial center part and end parts of the roller smaller than that of an axially not-divided single driving roller having a crown-like shape of an equal curvature to the roller. Since the difference, in diameter in the axial direction of the driving roller formed by the plurality of rollers, becomes smaller than that of the single driving roller, it is possible to make a difference in tension of the belt member in the axial direction of the driving roller smaller than that of the single driving roller accordingly. When the cooling roller and the belt member hold the sheet-like member therebetween, there is a smaller difference in pressure occurring in the axial direction of the driving roller from the belt member against the sheet of paper and, therefore, it is possible to reduce unevenness in gloss of an image on the sheet member caused by the difference in pressure.

The present embodiment can reduce unevenness in gloss of an image on a sheet of paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cooling device, comprising:

a cooling roller that cools down a sheet-like member by coming into contact with the sheet-like member;

a belt member that:

is rotatably extended by a plurality of extending members, presses the sheet-like member against the cooling roller, and holds and carries the sheet-like member;

a driving roller that serves as one of the plurality of extending members and drives to rotate the belt member, and a roller member that is opposite to the driving roller and provided at a downstream end of the cooling device without being brought into contact with a top surface of the belt member, wherein the driving roller is axially divided into a plurality of rollers, each of the plurality of rollers has a crown-like shape whose outer diameter continuously becomes larger from both end parts to a center part in an axial direction, and the roller member suppresses contact of a surface of the sheet-like member with a sharp end part of a discharge guide.

2. The cooling device according to claim 1, wherein the cooling roller has a heat radiator.

3. An image forming apparatus comprising:

a toner image forming unit that forms a toner image on a sheet-like member;

a fixing unit that fixes the toner image formed on the sheet-like member onto the sheet-like member at least by heat; and a cooling unit that cools down the sheet-like member, wherein the cooling device according to claim 1 is used as the cooling unit.

4. The image forming apparatus according to claim 3, wherein the cooling device is provided at a downstream side of the fixing unit in a sheet-like member carrying direction and the cooling device cools down the sheet-like member on which a toner image is fixed by the fixing unit.

5. The image forming apparatus according to claim 1, wherein the roller member is provided at a position between the cooling roller and the driving roller in a horizontal direction.

6. The image forming apparatus according to claim 1, wherein the belt member is a single flat belt having a substantial equal width to that of the driving roller in an axial direction.

7. The image forming apparatus according to claim 1, wherein a difference in diameter between at a center part and an end part in the axial direction of each of the plurality rollers is smaller than that of an axially undivided single driving roller having a crown-like shape with a curvature equal to that of each of the plurality rollers.

8. The image forming apparatus according to claim 1, wherein the belt member has a shape that waves along the crown-like shape of the plurality of rollers.

* * * * *